US005699922A

United States Patent [19]

Harding

[11] Patent Number: 5,699,922

[45] Date of Patent: Dec. 23, 1997

[54] DETACHABLE CLOSURE SYSTEM FOR AN OPEN-ENDED TUBULAR MEMBER

[75] Inventor: Claude J. Harding, Phoenix, Ariz.

[73] Assignee: MHD Corporation, Glendale, Ariz.

[21] Appl. No.: 651,000

[22] Filed: May 21, 1996

[51] Int. Cl.[6] ..... B65D 41/04; B65D 50/04; B65D 55/02

[52] U.S. Cl. ..... 215/208; 215/201; 215/217; 215/330; 220/256; 220/281

[58] Field of Search ..... 215/208, 201, 215/203, 206, 211, 214, 217, 218, 219, 220, 221, 222, 223, 216, 43, 44, 329, 330, 331, 332, 334, 336, 337, 339; 220/254, 255, 256, 281, 298, 300, 288, 297, 296

[56] References Cited

U.S. PATENT DOCUMENTS

| | | | |
|---|---|---|---|
| 33,002 | 8/1861 | Ludlow . | |
| 615,453 | 12/1898 | Hipkins . | |
| 3,514,003 | 5/1970 | Fitzgerald | 215/221 |
| 3,613,929 | 10/1971 | Treanor | 215/214 |
| 3,656,646 | 4/1972 | Taylor | 215/218 X |
| 3,759,411 | 9/1973 | Horvath . | |
| 3,782,575 | 1/1974 | Braun | 215/211 |
| 3,974,928 | 8/1976 | Domaracki et al. | 215/211 |
| 3,989,152 | 11/1976 | Julian . | |
| 5,071,020 | 12/1991 | Reutter | 220/301 X |
| 5,114,029 | 5/1992 | Gibilisco | 215/334 X |
| 5,147,053 | 9/1992 | Friedenthal | 215/211 X |
| 5,201,109 | 4/1993 | Harding . | |
| 5,394,601 | 3/1995 | Sutton et al. . | |
| 5,529,416 | 6/1996 | Favre | 215/334 X |

*Primary Examiner*—Allan N. Shoap
*Assistant Examiner*—Niki M. Kopsidas
*Attorney, Agent, or Firm*—James H. Phillips

[57] ABSTRACT

A container closure system includes a plurality of equally circumferentially distributed pins extending outwardly from the tubular neck of the container near the opening. A detachable cap consists of nested inner and outer cap members. The inner cap member is dimensioned to receive the container neck and includes a plurality of sidewall openings for receiving the pins. The outer cap member has a plurality of locking wedges disposed on its inner surface. The inner and outer cap members are assembled so as to permit mutual rotation. Thus, when the cap is emplaced over the open end of the container, the pins are received in the openings to thereby inhibit mutual rotation between the inner cap member and the container. Then, a twist of the outer cap member in a clockwise direction brings the ramp portion of each locking wedge into engagement with one of the pins, thereby drawing the cap and the tubular member together to effect a secure closure. Subsequently, rotation of the outer cap member in the counter-clockwise direction releases the closure. For certain applications, child proofing expedients are also included to prevent young children from opening the closure while providing easy opening facility for adults and older children.

21 Claims, 5 Drawing Sheets

DETACHABLE CLOSURE SYSTEM FOR AN OPEN-ENDED TUBULAR MEMBER

FIELD OF THE INVENTION

This invention relates to the closure arts and, more particularly, to a secure and facile detachable closure system for capping and uncapping an open-ended tubular member such as a vial, the neck of a bottle or jar, the filler neck of an engine radiator, and the like.

BACKGROUND OF THE INVENTION

The desired features for modern closure systems for containers are diverse and apparently contradictory. For example, consider the ideal closure for a medicine vial. Such a closure system should obtain tight sealing without any danger of over-tightening; easy opening even for the elderly, infirm and/or handicapped; tight, but essentially effortless, resealing; effective child proofing; tamper proofing if desired; and the closure system should be aesthetically pleasing as well as simple, reliable and inexpensive to fabricate. Various other containers, vials, jars, bottles and the like, would ideally have some or all these features according the individual usage. Yet, no such closure system has been fully realized in the prior art. Inevitably, even with the best of the prior art closure systems, because of the contradictory nature of some of these requirements, such as child proofing and ease of opening for the elderly, handicapped and/or infirm, the compromises which have been made have rendered the available closure systems deficient in one or more aspects. For example, closure systems which afford effective child proofing are often literally impossible to open by the elderly, handicapped and/or infirm and, in fact, are difficult to open even by healthy adults.

Similarly, consider the ideal radiator cap which should be easy to emplace and remove from the filler neck, but should seal securely with an accurately predetermined pressure applied to the gasket, O-ring or other sealing expedient employed. Further, the ideal radiator cap provides for an intermediate position between that at which it is fully sealed and that at which it can be removed, at which intermediate position the cap has been sufficiently loosened to permit the escape of steam through conventional overflow facilities. The purpose of this feature is one of safety as the danger of removing a pressurized radiator cap from a hot engine is notoriously well known.

It is to the definitive solution to these and other drawbacks of the prior art closure systems to which the present invention is directed.

OBJECTS OF THE INVENTION

It is therefore a broad object of this invention to provide an improved closure system for a tubular member.

It is another object of this invention to provide such an improved closure system which is very easy to manipulate, yet which is predictably sure in operation.

In another aspect, it is an object of this invention to provide such an improved closure system which may be readily child proofed without adversely affecting the ease of use feature.

In yet another aspect, it is an object of this invention to provide such an improved closure system which provides accurate and repeatable closure characteristics including the achievement of predetermined compressive forces applied to a seal member such as a gasket or an O-ring.

SUMMARY OF THE INVENTION

Briefly, these and other objects of the invention are achieved by a detachable closure system for a tubular member, such as a vial, the neck of a jar or bottle or a radiator filler neck, which is open-ended at at least one end. The system includes a plurality (typically two, three or four) of equally circumferentially distributed pins extending radially outwardly from the outer surface of the tubular member. A cap for detachably coupling with the pins to close the open end of the tubular member consists of inner and outer cap members assembled together. The inner cap member includes an inner cap member tubular body open at one end and having an inner diameter which exceeds the outer diameter of the tubular member and also has a plurality of circumferentially distributed openings, in the same number as the pins, extending axially from the inner cap member open end for a distance which exceeds the distance between the open end of the tubular member and one of the pins, the width of each opening being sufficient to receive one of the pins.

The outer cap member component of the cap includes an outer cap member tubular body, open at one end, having an inner diameter which exceeds the outer diameter of the inner cap member tubular body so that the inner cap member can be inserted into and assembled with the outer cap member. The outer cap member also a plurality, in the same number as the pins, of locking wedges disposed on an inner surface of the outer cap member tubular body. Each of the locking wedges includes a ramp portion. The inner and outer cap members incorporate cooperative assembly structure for fixing the outer cap member over the inner cap member in a coaxial nesting relationship to effect the cap assembly. The assembly means is adapted to permit mutual rotation between the outer cap member and the inner cap member.

With this configuration, when the cap is coaxially emplaced over the open end of the tubular member in juxtaposition such that the plurality of pins are received in the plurality of openings, mutual rotation between the inner cap member and the tubular member is thereby inhibited. Then, a twist of the outer cap member effects mutual rotation between the outer cap member and the inner cap member in a first direction (typically, clockwise) to bring the ramp portion of each locking wedge into engagement with one of the pins, thereby drawing the cap and the tubular member together to effect a secure closure. Subsequently, mutual rotation between the outer cap member and the inner cap member in the opposite direction (typically, counter-clockwise) releases the closure, thereby permitting removal of the cap from the tubular member.

For certain applications, child proofing expedients are also included in the system to prevent young children access to opening the closure while providing easy opening facility for adults and older children. In an exemplary embodiment including child proofing, a circumferential flange extends radially outwardly from the inner cap member tubular body adjacent its open end. The circumferential flange includes extensions of the openings in the inner cap member tubular body to accommodate the lengths of the pins and also at least one and typically two circumferentially directed deflector wedges. With this child proofing feature, the outer cap member tubular body further includes a locking tab positioned to engage and ride along each deflector wedge as the outer cap tubular body is rotated in the first direction and to be deflected radially inwardly thereby until the tabs clear the thick ends of the deflector wedges and spring outwardly to thereby lock the cap assembly to the tubular member by inhibiting rotation of the outer cap tubular body in the second direction. Subsequently, the cap assembly can be unlocked by deflecting the locking tabs radially inwardly sufficiently to clear the end of the deflector wedge and rotating said outer cap tubular body in said second direction. This step is easy for adults and older children, but is substantially impossible for younger children to perform.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DESCRIPTION OF THE PREFERRED EMBODIMENT(S)

Figure 1:
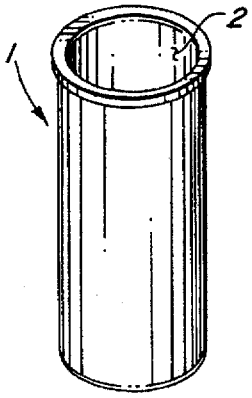
FIG. 1 shows a first exemplary environment in which the invention may be practiced constituting a medicine vial.

Referring now to FIG. 1, there is shown a medicine vial 1 which is generally tubular along its entire length and has an open end 2 which is intended to be normally capped. The vial 1 is exemplary of one type of container to which the present invention is applicable. That is, at least a portion of the container adjacent an opening which is to receive a closure according to the subject invention is tubular, having a circular cross section.

Figure 4:
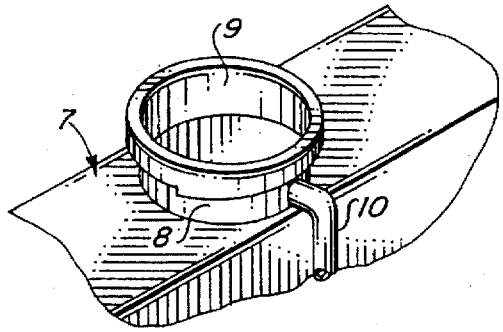
FIG. 4 shows a fourth exemplary environment in which the invention may be practiced constituting an engine radiator.
Figure 2:
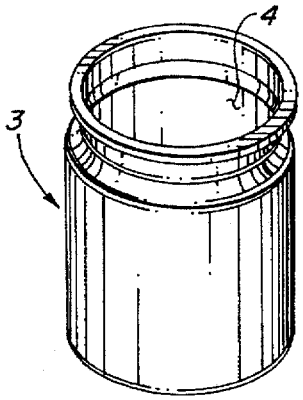
FIG. 2 shows a second exemplary environment in which the invention may be practiced constituting a jar.
Figure 3:
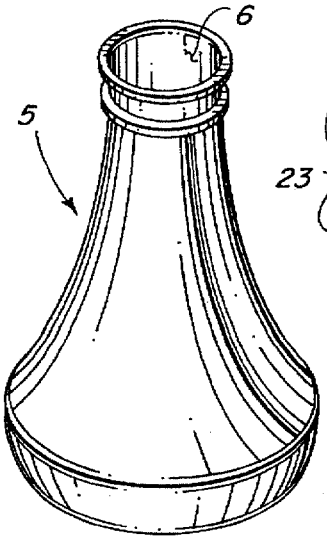
FIG. 3 shows a third exemplary environment in which the invention may be practiced constituting a bottle.

Other examples of containers to which the present invention is applicable include a jar 3 having an opening 4 adjacent a tubular neck region as shown in FIG. 2, a bottle 5 having an opening 6 as shown in FIG. 3, and, as an example of the diverse applications of the invention, an automotive radiator 7 having a tubular neck member 8 adjacent the opening 9 as shown in FIG. 4. As is well known in the radiator arts, an overflow tube 10 may be placed in fluid communication with the interior of the radiator 7 under certain conditions to provide venting and/or overflow. Thus, it will be understood that the subject closure system relates to any container having a tubular member open ended at at least one end which is adapted to receive a closure according to the invention.

Figure 5:
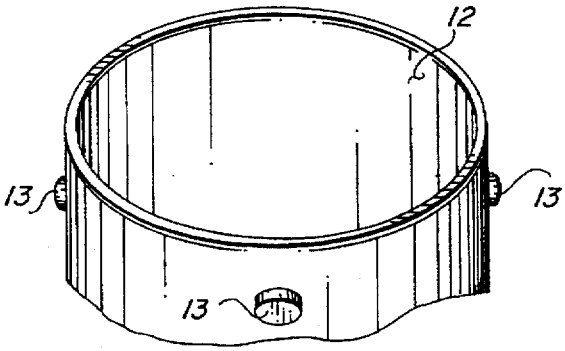
FIG. 5 is a partially cut away view illustrating a general representation of the type of container having at least a tubular section adjacent an opening which is adaptable to the closure system of the present invention.

FIG. 5 illustrates another feature which is characteristic of the invention. The exemplary tubular member 11, open ended at 12, includes a plurality of circumferentially distributed radially outwardly directed pins 13. The purpose of the pins, which may be fabricated integral with the tubular member 11 or added later by any suitable means, will become apparent as the description proceeds.

Figure 6:
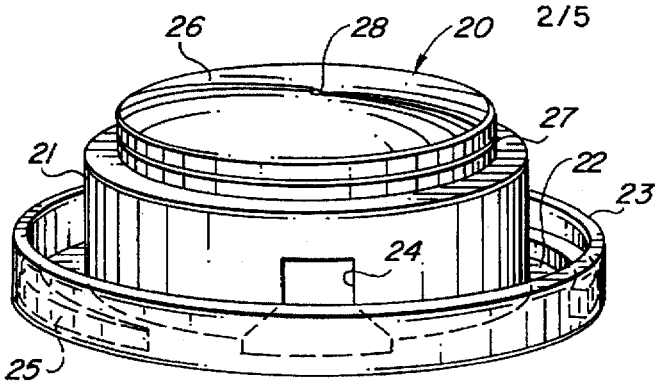
FIG. 6 is a partially cut away perspective view of an inner cap member component of the closure system of the present invention.

Thus, attention is directed to FIG. 6 which shows a first exemplary component of a two-piece cap assembly which, operating in conjunction with the pins 13 (FIG. 5), constitutes the subject closure system. More particularly, FIG. 6 illustrates an inner cap member 20 which includes an inner cap member tubular body 21. In the embodiment chosen for illustration, a flange 22 extends radially outwardly around the periphery of a lower, open end of the inner cap member tubular body 21.

The upper end of the inner cap member tubular body 21 is closed, preferably by a convex inner cap dome end member 26. The reason for the preference of a dome for the end member 26 will become more apparent as the description of the invention proceeds. As also will become more apparent below, the inner cap member 20 is assembled to an outer cap member, for example by the provision of inner cap coupling groove 27.

At the outer periphery of the flange 22, an upturned lip 23, shown partially cut away in FIG. 6 to reveal certain structure, is preferably provided. At least one deflector wedge 25, whose function will become more apparent below, is carried by the flange 22, preferably immediately adjacent the upturned lip 23. The deflector wedge 25 extends circumferentially and has graduated thickness along its length. An opening 24 extends longitudinally in the side wall of the inner cap member tubular body 21 and also radially outwardly across a portion of the flange 22.

Figure 7:
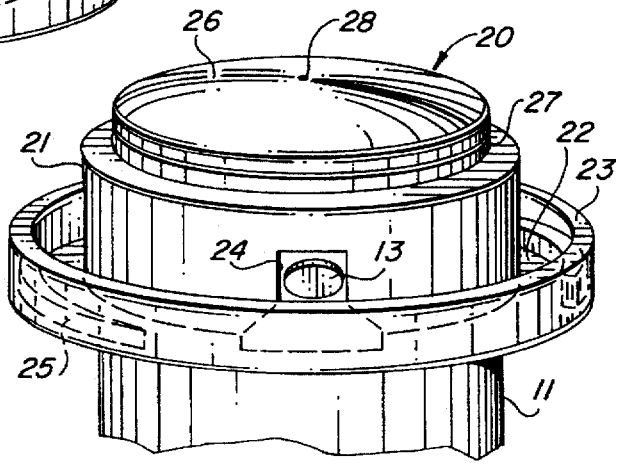
FIG. 7 is a view similar to FIG. 6 illustrating the inner cap member situated atop a container such as that illustrated in FIG. 5.

Referring to FIG. 7, the inner cap member 20 is shown in place over a tubular member 11, representative of the relevant portion of the diverse containers with which the subject invention finds use, such that the pins 13 are received into the opening 24 during the capping process. Thus, it will be understood that the inner cap member 20 rests atop the tubular member 11 to close off the opening 12 (FIG. 5). Preferably, at least one pair of diametrically opposed, aligned pins 13 extending radially outwardly from the outer surface of the inner cap member tubular body 21 are provided. Similarly, additional pairs of pins 13 may be provided, for example, two pairs of diametrically opposed pins 13 may be situated disposed ninety degrees apart to provide four equally peripherally distributed, radially outwardly extending pins. Alternatively, an odd number, such as three, pins 13 may be provided and preferably situated equally circumferentially distributed about the tubular member 11. The pins 13 are positioned a short distance below the open end of the tubular member 11 and may have any appropriate cross section such as the ellipse shown, round or such other cross section as may be desired. Of course, it is contemplated that there are as many openings 24 provided in the inner cap member tubular body 21 as necessary to accommodate the pins in a given embodiment, and the openings are appropriately circumferentially distributed to receive all the pins.

In order to fully accommodate the pins 13, the openings 24 extend radially outwardly into the flange 22 for a distance which exceeds the length of the pins 13 while the portion of the openings 24 along the side wall of the inner cap member tubular body 21 extend longitudinally for a sufficient distance that the inner cap member 20 rests on the end of the tubular member 11 rather than atop the pins 13.

Figure 8:
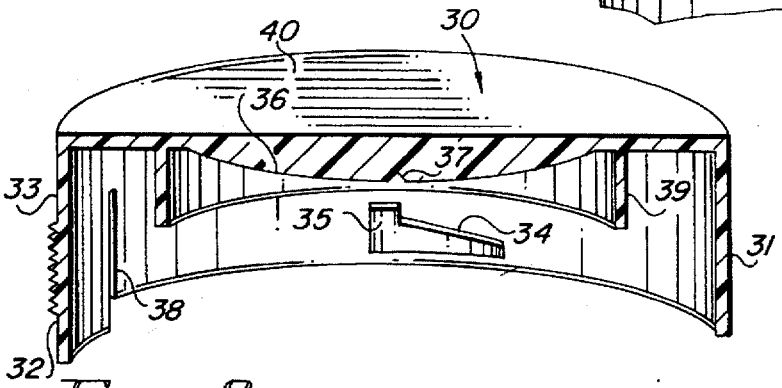
FIG. 8 is a cross sectional view of an outer cap member component of the closure system of the present invention.

Attention is now directed to FIG. 8 which shows an outer cap member component 30 of the cap assembly according to the present invention. The outer cap member 30 includes an outer cap member tubular body 31 having one or more locking tabs 32 situated about the tubular body circumference. Typically, two diametrically opposed locking tabs 32 will be employed. In one presently preferred embodiment, the locking tabs 32 are rendered more radially flexible by providing longitudinal slots 38 adjacent each side of each tab 32. In addition, for reasons which will become more apparent below, the locking tabs 32 extend downwardly beyond the lower edge of the outer cap member tubular body 31 in the presently preferred embodiment of the cap assembly constituting inner cap member 20 and outer cap member 30.

Figure 10A:
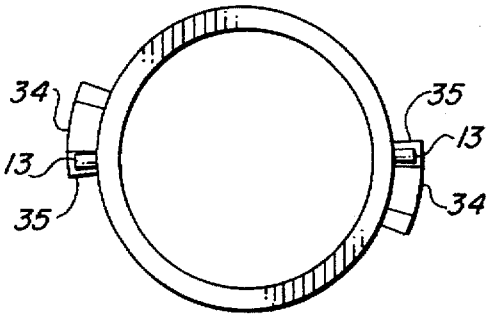
FIGS. 10A, 10B, 10C, 10D, 10E, 10F are top views of a tubular structure incorporating certain pin elements of the subject invention and respectively illustrate the disposition of exemplary embodiments of the invention using two, four and three pins.
Figure 10D:
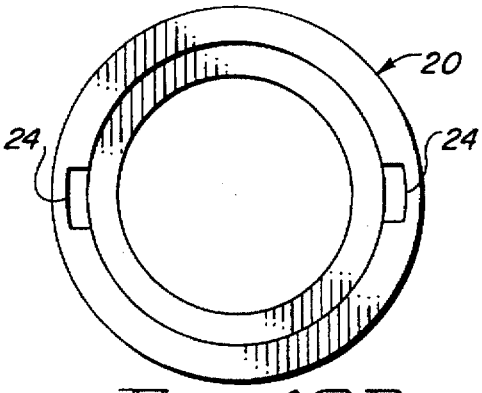
Figure 10B:
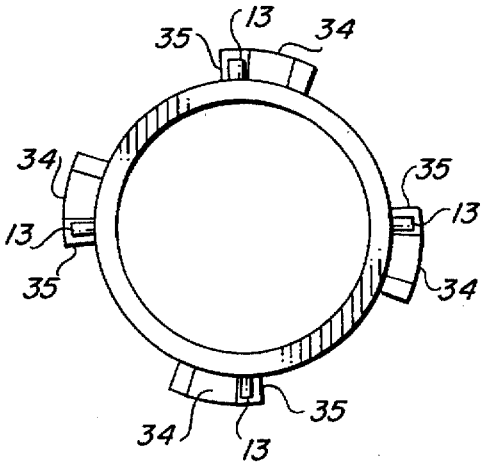
Figure 10E:
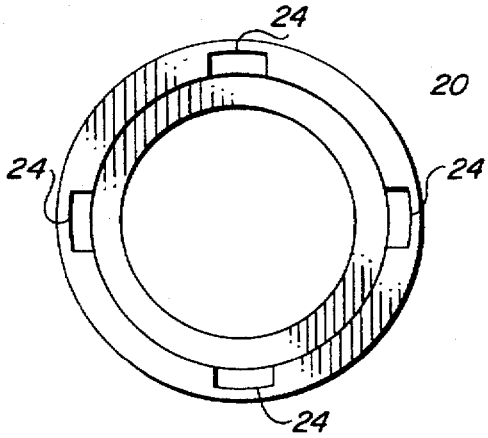
Figure 10C:
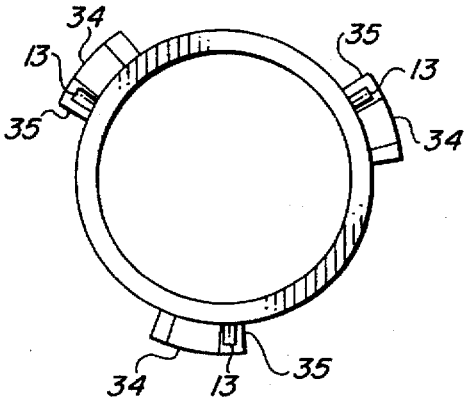
Figure 10F:
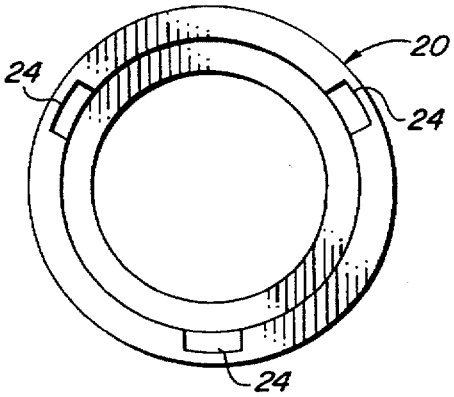

Disposed on the inner surface of the outer cap member tubular body 31 are one or more (typically two, three or four) locking wedges 34, which interact with the pins 13 as will be discussed further below. Thus, it will be understood that there are as many locking wedges 34 carried by the tubular body 31 as there are pins employed in a given embodiment, and the circumferential distribution of the pins and locking wedges is the same. That is, if a pair of diametrically opposed pins 13 is carried by a tubular member 11 (FIG. 7), then there is provided a pair of diametrically opposed locking wedges 34 on the inside surface of the outer cap member tubular body 31. Similarly, if there are three pins 13 distributed 120 degrees apart on the tubular member 11, then there are three corresponding locking wedges 34 distributed 120 degrees apart, or if there are two pairs of diametrically pairs of pins 13, four locking wedges are provided and appropriately situated. Referring briefly to FIGS. 10A, 10B and 10C, the preferred distributions of two, three and four pins 13 on a tubular member 11 will be appreciated, and it will be understood that the locking wedges 34 are correspondingly distributed. Similarly, FIGS. 10D, 10E and 10F show the respective circumferential orientations of the openings 24 in the inner cap member 20 which receive the pins 13 as respectively provided and disposed in FIGS. 10A, 10B and 10C.

The contour of the working surface of the locking wedge 34 will be discussed further below, but may be generally designated as a ramp. Preferably, a stop section 35 of the locking wedge 34 is provided to limit mutual rotation between the inner cap member 20 and the outer cap member 30 as will be discussed further below.

The outer cap member 30 is closed at one end 40, and the internal structure of the closed end 40 includes a downwardly directed convex dome portion 36 having a bearing 37 provided at its axial center point. In order to obtain a relatively rigid and stable structure, a downwardly depending stabilizer wall 33 may be provided outside and coaxial with the outer cap dome 36 and inboard of the tubular body 31. A circumferential outer cap coupling ring 39 extends circumferentially around the inner wall of the stabilizer wall 33.

Figure 9:
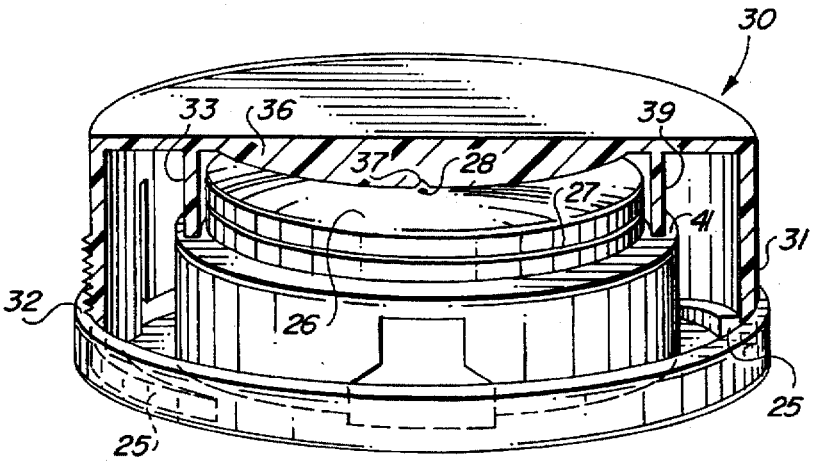
FIG. 9 is a partially cross sectional, partially cut away view of a cap member resulting from the union of the inner cap member shown in FIG. 6 and the outer cap member shown in FIG. 8.

FIG. 9 illustrates a cap assembly made up of the inner cap member 20 over which the outer cap member 30 has been snapped. The cap members 20, 30 are held together by the cooperation of the inner cap coupling groove 27 which is configured and dimensioned to receive the outer cap coupling ring 39 when suitable downward pressure is exerted to cause the stabilizer wall 33 to flex outwardly temporarily until the coupling ring 39 is snapped in place in the coupling groove 27. (It will be readily apparent to those skilled in the art that the coupling means shown may be replaced by many suitable expedients such as the reversal of the ring and groove position, ring segments which are not continuous, but are distributed about the periphery of the stabilizer wall 33, etc.) The dimensions of the inner cap member 20 and the outer cap member 30 are selected such that the bottom of the stabilizer wall 33 rides with slight clearance from a ledge portion 41 of the inner cap member. Mutual rotation between the inner cap member 30 and the outer cap member 30 is facilitated by the fit of the pivot 28 into the bearing 37, and the facing dome shape configurations of the inner cap dome 26 and the outer cap dome 36 result in a minimum of rotational friction while the bottom of the stabilizer wall 33 riding just above the ledge 41 limits rocking around the pivot 28. The longitudinal length of the outer cap tubular body 31 is such that, with the exception of the locking tabs 32, the bottom edge of the tubular body 31 rides above the deflector wedges 25.

Figure 11:
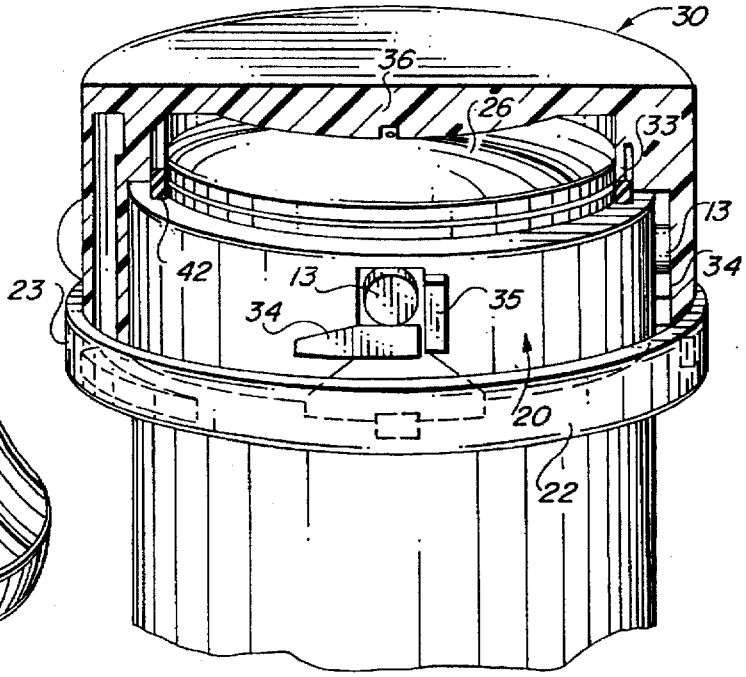
FIG. 11 is a cross sectional view of a closure system according to the invention illustrating certain features including those which minimize rotational friction encountered during mutual rotation between inner and outer cap members of the cap assembly as the cap member is affixed to and removed from a container.

Attention is now directed to FIG. 11 which is a cross section of a capped tubular body 11 having pins 13 as previously described and a cap assembly consisting of the union of the inner cap member 20 and the outer cap member 30 illustrating the relationship of the various components and providing additional insight into the minimization of rotational friction. Thus, as previously described, the cap assembly is placed atop the open end of the tubular body 11 with the pins 13 extending into the openings 24 (FIG. 6). Then, while grasping the tubular body 11 and thus constraining the inner cap 20 against rotation, the outer cap member 30 is rotated in a clockwise direction (looking downwardly onto the cap assembly) such that the pins 13 engage the ramp surface of the locking wedges 34 and pull the closure against the top edge of the tubular body 11. (If desired or appropriate for a given application, a seal, such as exemplary gasket 42, may be employed to provide addition fluid sealing.) As also previously mentioned, a stop 35 (not shown in FIG. 11 ) associated with the locking wedges 34 may be employed to limit the amount of rotation available between the inner cap member 20 and outer cap member 30 to a predetermined angle.

It will be seen that, during the locking process, rotational friction is low because of the limited contact between the inner cap member 20 and the outer cap member 30 which takes place at the axial bearing point at the apex of each of the facing inner cap dome 26 and outer cap dome 36. There is also sliding/rotational friction between the pins 13 and the locking wedges 34, but this source of friction can be limited by appropriate choice of materials and finish for the pins 13 and locking wedges 34 as well as the choice of the slope contour for the working surface of the locking wedges. Some slight additional friction results from the inevitable light rubbing between the bottom edge of the stabilizing wall 33 and the ledge 41 of the inner cap member 20 as best shown in FIG. 9. Nonetheless, the summation of the rotational friction between the inner cap member 20 and the outer cap member 30 is small such that secure locking and opening (by turning the outer cap member 30 counter-clockwise in the example) is easily achieved, even by the infirm, handicapped and elderly.

Figure 12:
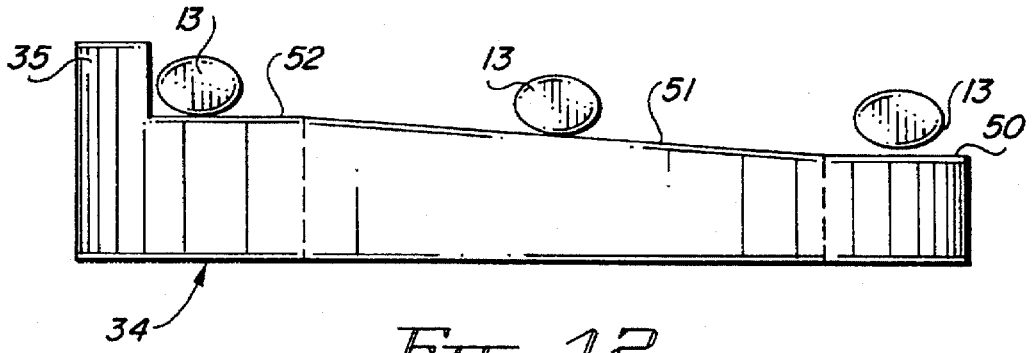
FIG. 12 is a side view of a first contour for a locking wedge element carried by the outer cap member.

The contour of the working surface of the locking wedges 34 on which the pins 13 ride during the closing and opening operations may vary to obtain appropriate results in given applications. Thus, referring to FIG. 12, a simple contour is illustrated which includes a lower plateau 50 above which the pin 13 is situated with slight clearance when the cap assembly is in place on the tubular neck of a container, but has not yet been tightened. Referring as necessary also to FIGS. 6–11, as the outer cap member 30 is rotated to cause translation of the locking wedges 34 with respect to the pins 13, pin 13 of FIG. 12 engages a linear ramp portion 51 of the locking wedge 34 until the container and cap assembly have been pulled together an amount corresponding to the rise between the lower plateau 50 and an upper plateau 52. As previously mentioned, a stop element 35 may be included with the locking wedge to limit rotation. Thus, the amount of compression obtained between the cap assembly and the container being closed off can be closely controlled by the choice of the angle of the incline 51 and the choice of materials, material thicknesses, etc., which affect the flexibility of the several components.

Figure 13:
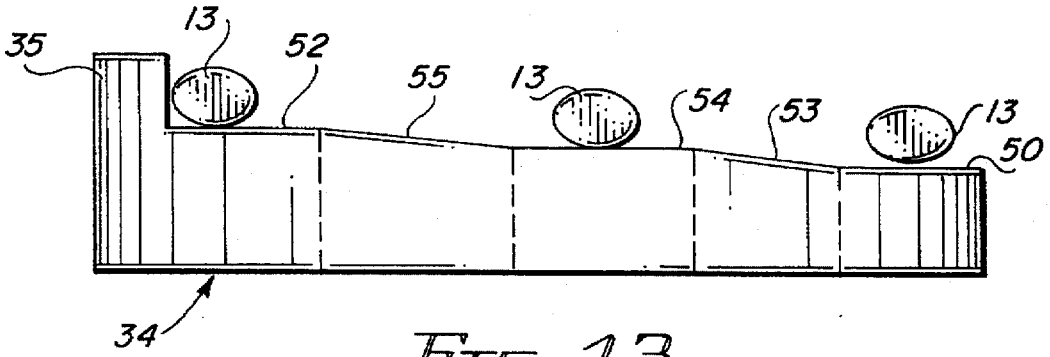
FIG. 13 is a side view of a second contour for a locking wedge element carried by the outer cap member.

The ramp contour shown in FIG. 13 is exemplary of one appropriate for such applications as a pressurized radiator cap. The lower plateau 50 leads to a first inclined ramp portion 53 which reaches an intermediate plateau 54 which leads to a second inclined ramp portion 55 which reaches the upper plateau 52 which also carries the stop element 35 if provided. With this configuration, an already tightened radiator cap, assumed to be under pressure from steam, can be loosened so that the pin 13, which would be riding against the stop element 35, rides across the upper plateau 52 and down the upper ramp portion 55 to the intermediate plateau 54. In this intermediate position, assuming that the dimensions have been appropriately chosen, the built up steam pressure may be safely vented through the overflow tube 10 (FIG. 4) in the well known manner until the cap assembly can be removed by further counter-clockwise translation whereby the pin 13 rides across the remainder of the intermediate plateau 54 and down the lower ramp portion 53 to the lower plateau 50 such that the radiator cap can be removed.

Figure 14:
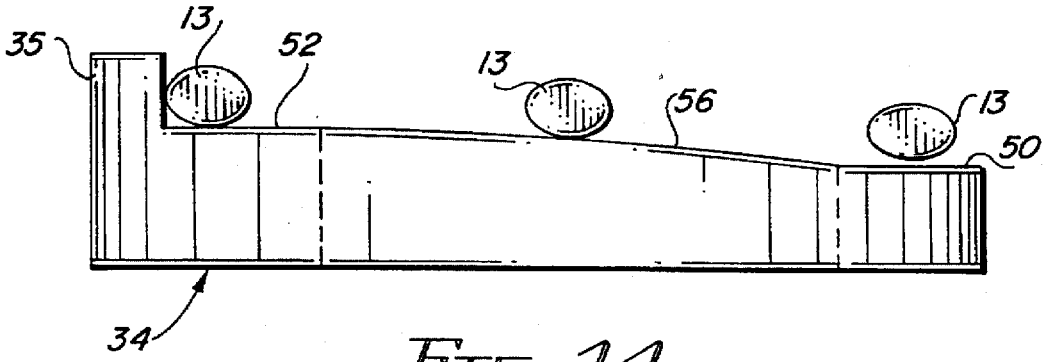
FIG. 14 is a side view of a third contour for a locking wedge element carried by the outer cap member.

FIG. 14 illustrates another ramp contour which finds wide use. Disposed intermediate lower plateau 50 and upper plateau 52 is a ramp portion 56 which is not linear, but rather has a decreasing slope angle as a pin 13 translates from the lower plateau to the upper plateau. That is, as the pin approaches the upper plateau 50, the slope is smaller; as a result, added leverage is obtained because there is less compressive axial movement obtained for a given angular rotation. The advantage of this slope configuration is that, as the cap assembly is tightened, the increase in leverage serves to offset the increase in the compressive forces tending to push the cap assembly and tubular member to which it has been coupled apart. The practical effect is that the cap assembly is easier both to tighten and to loosen. Other contours than the several shown as examples may be appropriate for other, diverse applications.

Of course, it will be appreciated that a non-linear slope as shown in FIG. 14 may be used for one or both the upper and lower ramp portions shown in the FIG. 13 embodiment. In particular, the upper ramp portion 55 may be configured to obtain the added leverage which renders final closure of, for example, a radiator cap easy, yet closely controlled as to the final compressive force applied to a sealing element such as a gasket or O-ring.

Figure 15:
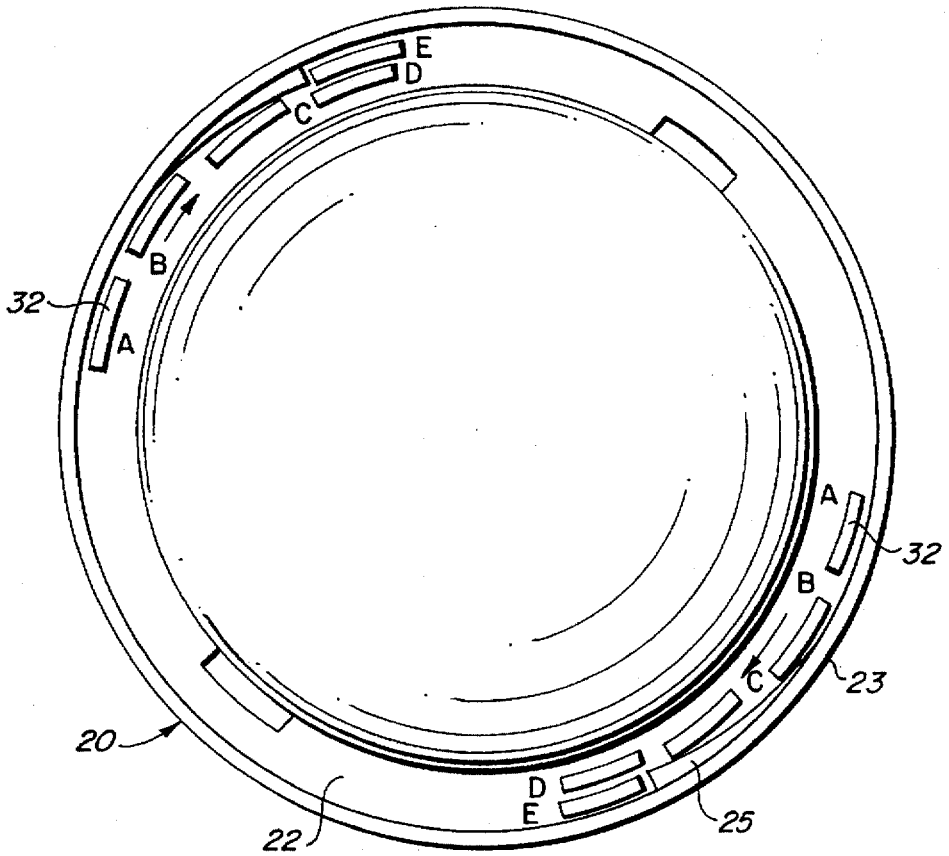
FIG. 15 is a top view of the inner cap member particularly showing the progressive relationship of a locking tab element carried by the outer cap member with a deflector wedge element carried by the inner cap member during mutual rotation therebetween to effect child proofing.

As has been previously mentioned, it is desirable, in such applications of the subject closure system as for medicine vials and bottles, to render the closure "child proof"; i.e., difficult or impossible for small children to remove a closed cap assembly while, at the same time, only slightly increasing the skill and dexterity required of an adult attempting to open the container. As best shown in FIG. 15, which is a top view of the inner cap member 20, this end is achieved by the cooperation of locking tabs 32 carried by the outer cap member 30 (only the locking tabs 32 of the outer cap member 30 are shown in FIG. 15) as previously described and deflector wedges 25 carried by the flange 22 of the inner cap member 20 as also previously described. Thus, as the outer cap member is rotated clockwise such that the locking tabs 32 (a diametrically opposed pair are shown in FIG. 15), progress through positions A, B, C, D, they are forced radially inwardly by the contour of the working surface of the deflector wedges 35 until position E is reached where the locking tabs clear the thick ends of the deflector wedges and spring back to their normal orientation. It will be apparent that when the locking tabs 25 are in this position, counter-clockwise rotation of the outer cap member is prevented by the engagement of the locking tabs with the ends of the deflector wedges such that the cap assembly cannot be removed without somehow releasing the locking tabs.

Figure 16:
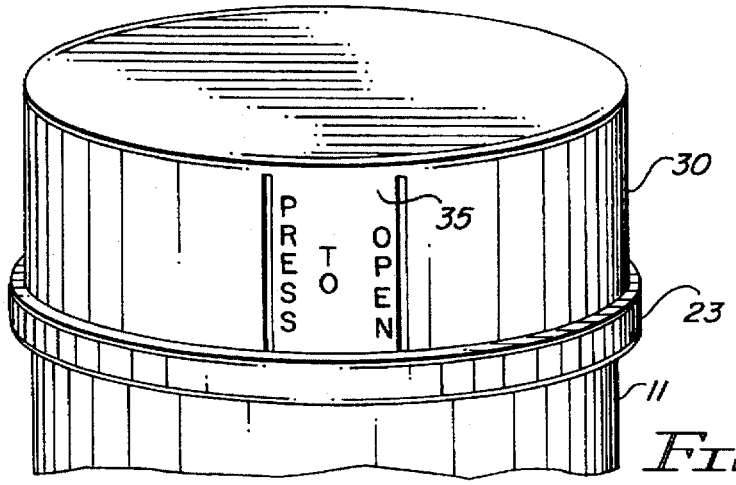
FIG. 16 a perspective view illustrating a cap assembly according to the invention mounted to a container and particularly showing the child proofing feature.

The manner in which the locking tabs are released may be understood by reference also to FIG. 16. The container represented by the tubular body 11 is grasped with one hand while the outer cap is rotated counter-clockwise. Simultaneously, the locking tab 35 and a diametrically opposed locking tab which is out of view in FIG. 16, are pinched inwardly. Still referring also to FIG. 15, the radially inwardly deflection of the locking tabs 35 is sufficient to permit their clearing the ends of the locking wedges 25 as they move from position D to positions C, B and A. When position A is reached, the cap assembly can be removed from the container. It has been found that small children do not have the coordination and/or finger strength required to open the container locked in this manner, but it is a simple matter for older children and adults to do so.

Thus, while the principles of the invention have now been made clear in illustrative embodiments, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A detachable closure system comprising:

A) a tubular member, said tubular member being open-ended at a first end thereof;

B) at least one pair of diametrically opposed pins extending radially outwardly from an outer surface of said tubular member;

C) an outer cap member and an inner cap member;

1) said inner cap member including:

a) an inner cap member tubular body having an inner diameter which exceeds the outer diameter of said tubular member, said inner cap member tubular body being open-ended at a first end thereof and closed at a second end thereof;

b) at least one pair of diametrically opposed openings, each said opening extending axially from said first end of said inner cap member tubular body for a distance which exceeds the distance between said first end of said tubular member and one of said pins, the width of each said opening being sufficient to receive one of said pins; and c) a lower coaxial dome member having an apex extending from said second end of said inner cap member tubular body away from said first end thereof; and 2) said outer cap member including:

a) an outer cap member tubular body having an inner diameter which exceeds the outer diameter of said inner cap member tubular body, said outer cap member tubular body being open-ended at a first end thereof;

b) an upper coaxial dome member having an apex extending from said second end of said outer cap member tubular body toward said first end thereof and facing said apex of said upper coaxial dome member; and c) at least one pair of circumferentially oriented, diametrically opposed locking wedges disposed on an inner surface of said outer cap member tubular body, each said locking wedge including a ramp portion; and D) assembly means for fixing said outer cap member over said inner cap member in a coaxial nesting relationship to effect a cap assembly, said assembly means being adapted to permit mutual rotation between said outer cap member and said inner cap member;

whereby, when said cap assembly is coaxially emplaced over said first end of said tubular member in juxtaposition such that said pins are received in said openings to thereby inhibit mutual rotation between said inner cap member and said tubular member, mutual rotation between said outer cap member and said inner cap member in a first direction brings said ramp portion of each said locking wedge into engagement with one of said pins, said mutual rotation in said first direction thereby drawing said cap assembly and said tubular member together; and mutual rotation between said outer cap member and said inner cap member in a second direction permits removal of said cap assembly from said tubular member and further whereby, when said inner and outer cap members are assembled, a bearing point for mutual rotation therebetween is established at the facing apexes of said upper and lower domes.

2. A detachable closure system comprising:

A) a tubular member, said tubular member being open-ended at a first end thereof;

B) at least one pair of diametrically opposed pins extending radially outwardly from an outer surface of said tubular member;

C) an inner cap member comprising:

1) an inner cap member tubular body having an inner diameter which exceeds the outer diameter of said tubular member, said inner cap member tubular body being open-ended at a first end thereof;

2) a circumferential flange extending radially outwardly proximate said first end of said inner cap member tubular body; and 3) at least one pair of diametrically opposed openings, each said opening extending axially from said first end of said inner cap member tubular body for a distance which exceeds the distance between said first end of said tubular member and one of said pins, each said opening extending radially outwardly in said circumferential flange for a distance which is greater than the length of said pins, the width of each said opening being sufficient to receive one of said pins;

D) an outer cap member comprising:

1) an outer cap member tubular body having an inner diameter which exceeds the outer diameter of said inner cap member tubular body, said outer cap member tubular body being open-ended at a first end thereof; and 2) at least one pair of circumferentially oriented, diametrically opposed locking wedges disposed on an inner surface of said outer cap member tubular body, each said locking wedge including a ramp portion; and E) assembly means for fixing said outer cap member over said inner cap member in a coaxial nesting relationship to effect a cap assembly, said assembly means being adapted to permit mutual rotation between said outer cap member and said inner cap member;

whereby, when said cap assembly is coaxially emplaced over said first end of said tubular member in juxtaposition such that said pins are received in said openings to thereby inhibit mutual rotation between said inner cap member and said tubular member, mutual rotation between said outer cap member and said inner cap member in a first direction brings said ramp portion of each said locking wedge into engagement with one of said pins, said mutual rotation in said first direction thereby drawing said cap assembly and said tubular member together to effect a closure; and mutual rotation between said outer cap member and said inner cap member in a second direction releases said closure, thereby permitting removal of said cap assembly from said tubular member.

3. The detachable closure system of claim 2 in which said diametrically opposed pins are axially aligned.

4. The detachable closure system of claim 2 which includes:

A) at least two pairs of said diametrically opposed pins;

B) at least two pairs of diametrically opposed openings;

C) at least two pairs of diametrically opposed locking wedges; and in which:

D) said pins, said openings and said locking wedges are equally circumferentially distributed.

5. The detachable closure system of claim 3 which includes:

A) at least two pairs of said diametrically opposed pins;

B) at least two pairs of diametrically opposed openings; and

C) at least two pairs of diametrically opposed locking wedges;

and in which:

D) said pins, said openings and said locking wedges are equally circumferentially distributed.

6. The detachable closure system of claim 2 in which:

A) said circumferential flange further includes at least one circumferentially directed deflector wedge; and B) said outer cap member tubular body further includes a locking tab positioned to engage and ride along said deflector wedge as said outer cap tubular body is rotated in said first direction and to be deflected radially inwardly thereby until said tab clears an end of said deflector wedge and springs outwardly to thereby lock said cap assembly to said tubular member by inhibiting rotation of said outer cap tubular body in said second direction and such that said cap assembly can be unlocked by deflecting said locking tab radially inwardly sufficiently to clear said end of said deflector wedge and rotating said outer cap tubular body in said second direction.

7. The detachable closure system of claim 6 which includes a pair of diametrically opposed deflector wedges and a corresponding pair of diametrically opposed locking tabs.

8. The detachable closure system of claim 6 which further includes a pair of longitudinal slots in said outer cap member tubular body, said longitudinal slots being provided adjacent said locking tab and on either side thereof to thereby render said tab more susceptible to radial deflection.

9. The detachable closure system of claim 7 which further includes first and second pairs of longitudinal slots in said outer cap member tubular body, each pair of said longitudinal slots being provided adjacent one of said locking tabs and on either side thereof to thereby render said tabs more susceptible to radial deflection.

10. The detachable closure system of claim 2 in which:

A) said outer cap member is closed at a second end thereof and in which said outer cap member further includes an upper coaxial dome depending from said second end toward said first end of said outer cap member; and B) said inner cap member is closed at a second end thereof and in which said inner cap member further includes a lower coaxial dome member depending from said second end away from said first end of said inner cap member;

whereby, when said inner and outer cap members are assembled, a bearing point for mutual rotation therebetween is established at the facing apexes of said upper and lower domes.

11. The detachable closure system of claim 2 in which said locking wedges each include first and second ramp portions joined by a plateau portion to provide a predetermined position intermediate that at which said cap assembly may be removed from said tubular member and that at which said cap assembly is fully engaged with said tubular member.

12. The detachable closure system of claim 2 in which said locking wedges each include non-linear ramp portions.

13. The detachable closure system of claim 11 in which said locking wedges each include non-linear ramp portions.

14. A detachable closure system comprising:

A) a tubular member, said tubular member being open-ended at a first end thereof;

B) at least three pins extending radially outwardly from an outer surface of said tubular member;

C) an inner cap member comprising:

1) an inner cap member tubular body having an inner diameter which exceeds the outer diameter of said tubular member, said inner cap member tubular body being open-ended at a first end thereof;

2) a circumferential flange extending radially outwardly proximate said first end of said inner cap member tubular body; and 3) at least three openings, each said opening extending axially from said first end of said inner cap member tubular body for a distance which exceeds the distance between said first end of said tubular member and one of said pins, said openings being circumferentially distributed the same angular distances as said pins, each said opening extending radially outwardly in said circumferential flange for a distance which is greater than the length of said pins, the width of each said opening being sufficient to receive one of said pins;

D) an outer cap member comprising:

1) an outer cap member tubular body having an inner diameter which exceeds the outer diameter of said inner cap member tubular body, said outer cap member tubular body being open-ended at a first end thereof; and 2) at least three circumferentially oriented locking wedges disposed on an inner surface of said outer cap member tubular body, said locking wedges being circumferentially distributed the same angular distances as said pins, each said locking wedge including a ramp portion; and E) assembly means for fixing said outer cap member over said inner cap member in a coaxial nesting relationship to effect a cap assembly, said assembly means being adapted to permit mutual rotation between said outer cap member and said inner cap member;

whereby, when said cap assembly is coaxially emplaced over said first end of said tubular member in juxtaposition such that said pins are received in said openings to thereby inhibit mutual rotation between said inner cap member and said tubular member, mutual rotation between said outer cap member and said inner cap member in a first direction brings said ramp portion of each said locking wedge into engagement with one of said pins, said mutual rotation in said first direction thereby drawing said cap assembly and said tubular member together to effect a closure; and mutual rotation between said outer cap member and said inner cap member in a second direction releases said closure, thereby permitting removal of said cap assembly from said tubular member.

15. The detachable closure system of claim 14 in which:

A) said circumferential flange further includes at least one circumferentially directed deflector wedge; and B) said outer member tubular body further includes a locking tab positioned to engage and ride along said deflector wedge as said outer cap tubular body is rotated in said first direction and to be deflected radially inwardly therby until said locking tab clears an end of said deflector wedge and springs outwardly to thereby lock said cap assembly to said tubular member by inhibiting rotation of said outer cap tubular body in said second direction and such that said cap assembly can be unlocked by deflecting said deflector wedge and rotating said outer cap tubular body in said second direction.

16. The detachable closure system of claim 15 which further includes a pair of longitudinal slots in said outer cap member tubular body, said longitudinal slots being provided adjacent said locking tab on either side thereof to thereby render said locking tab more susceptible to radial deflection.

17. The detachable closure system of claim 15 which includes a pair of diametrically opposed deflector wedges and a corresponding pair of diametrically opposed locking tabs and which further includes first and second pairs of longitudinal slots in said outer cap member tubular body, each pair of said longitudinal slots being provided adjacent one of said locking tabs and on either side thereof to thereby render said locking tabs more susceptible to radial deflection.

18. The detachable closure system of claim 15 in which:

A) said outer cap member is closed at a second end thereof and in which said outer cap member further includes an upper coaxial dome having an apex extending from said second end toward said first end of said outer cap member tubular body; and B) said inner cap member is closed at a second end thereof and in which said inner cap member further includes a lower coaxial dome member having an apex extending from said second end away from said first end of said inner cap member tubular body and facing said apex of said upper coaxial dome member;

whereby, when said inner and outer cap members are assembled, a bearing point for mutual rotation therebetween is established at the facing apexes of said upper and lower domes.

19. The detachable closure system of claim 15 in which said locking wedges each include first and second ramp portions joined by a plateau portion to provide a predetermined position intermediate that at which said cap assembly may be removed from said tubular member and that at which said cap assembly is fully engaged with said tubular member.

20. The detachable closure system of claim 15 in which said locking wedges each include non-linear ramp portions.

21. The detachable closure system of claim 19 in which said locking wedges each include non-linear ramp portions.

* * * * *